US008478162B2

(12) United States Patent
Arasawa

(10) Patent No.: US 8,478,162 B2
(45) Date of Patent: Jul. 2, 2013

(54) IMAGE FORMING APPARATUS

(75) Inventor: Shinichi Arasawa, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 272 days.

(21) Appl. No.: 12/805,849

(22) Filed: Aug. 20, 2010

(65) Prior Publication Data

US 2011/0052256 A1 Mar. 3, 2011

(30) Foreign Application Priority Data

Sep. 1, 2009 (JP) ..... 2009-201598

(51) Int. Cl.
*G03G 21/16* (2006.01)

(52) U.S. Cl.
USPC ..... 399/111; 399/90; 399/411

(58) Field of Classification Search
USPC ..... 399/90, 111, 411
See application file for complete search history.

(56) References Cited

U.S. PATENT DOCUMENTS

| | | | | |
|---|---|---|---|---|
| 5,159,458 | A * | 10/1992 | Murata et al. | 348/207.99 |
| 7,424,263 | B2 | 9/2008 | Shimizu et al. | |
| 7,623,821 | B2 | 11/2009 | Kubota et al. | |
| 7,634,213 | B2 | 12/2009 | Yoshida et al. | |
| 7,706,724 | B2 | 4/2010 | Kawakami et al. | |
| 2003/0215257 | A1 * | 11/2003 | Karakama et al. | 399/111 |
| 2008/0089727 | A1 | 4/2008 | Shimizu et al. | |
| 2008/0095559 | A1 | 4/2008 | Shimizu et al. | |
| 2008/0145108 | A1 | 6/2008 | Yoshida et al. | |
| 2008/0145119 | A1 | 6/2008 | Tatsumi et al. | |
| 2008/0152408 | A1 | 6/2008 | Kawakami et al. | |
| 2008/0170875 | A1 * | 7/2008 | Kim et al. | 399/111 |
| 2008/0170898 | A1 | 7/2008 | Shimizu et al. | |
| 2008/0181692 | A1 | 7/2008 | Tatsumi et al. | |
| 2008/0187358 | A1 | 8/2008 | Kubota et al. | |
| 2008/0205930 | A1 | 8/2008 | Kawakami et al. | |
| 2008/0219698 | A1 | 9/2008 | Shimizu et al. | |
| 2008/0267661 | A1 | 10/2008 | Yoshida et al. | |
| 2008/0279586 | A1 | 11/2008 | Tatsumi et al. | |
| 2008/0292356 | A1 * | 11/2008 | Furuichi et al. | 399/111 |
| 2009/0022531 | A1 | 1/2009 | Kubota et al. | |
| 2009/0047037 | A1 * | 2/2009 | Miyabe et al. | 399/111 |
| 2009/0110430 | A1 | 4/2009 | Kubota et al. | |
| 2009/0154973 | A1 | 6/2009 | Shimizu et al. | |
| 2009/0162101 | A1 | 6/2009 | Yoshida et al. | |
| 2009/0169246 | A1 | 7/2009 | Ooyoshi et al. | |
| 2009/0169265 | A1 | 7/2009 | Yoshida et al. | |
| 2010/0158556 | A1 * | 6/2010 | Miyabe et al. | 399/111 |

FOREIGN PATENT DOCUMENTS

| | | |
|---|---|---|
| JP | 2007-237657 | 9/2007 |
| JP | 2008-185971 | 8/2008 |
| JP | 2009-109854 | 5/2009 |

* cited by examiner

*Primary Examiner* — Ryan Walsh
(74) *Attorney, Agent, or Firm* — Harness, Dickey & Pierce P.L.C.

(57) ABSTRACT

A protruding portion that protrudes further toward a process cartridge than a contact portion coming in contact with a recording medium is provided at a contact terminal. A slide contact surface portion of the process cartridge is in a state of being in sliding contact with the protruding portion of the contact terminal by action of inserting the process cartridge, and the protruding portion is pressed in a direction being apart from the recording medium to limit contact between the contact terminal and the recording medium. The protruding portion fits in a fitting concave portion at a predetermined mounted position to make the contact terminal come in contact with the recording medium. The protruding portion is pulled out from the fitting concave portion by action of taking out the process cartridge to be in sliding contact with the slide contact surface portion.

23 Claims, 8 Drawing Sheets

IMAGE FORMING APPARATUS

CROSS-REFERENCE TO RELATED APPLICATIONS

The present application claims priority to and incorporates by reference the entire contents of Japanese Patent Application No. 2009-201598 filed in Japan on Sep. 1, 2009.

BACKGROUND OF THE INVENTION

1. Field of the Invention

The present invention relates to an image forming apparatus such as a printer, a copier, a fax, and a scanner and particularly relates to an image forming apparatus including a process cartridge on which a recording medium is mounted.

2. Description of the Related Art

Typical image forming apparatuses, specifically, small so-called low-end apparatuses have employed a process cartridge system in which electrophotographic process units are detachable to the main bodies of the image forming apparatuses (Japanese Patent Application Laid-open No. 2009-109854 and Japanese Patent Application Laid-open No. 2008-185971). With this structure, the process units are formed into cartridges by integrating at least one of charging units, developing units, and cleaning units and photosensitive bodies as image carriers (these are members for electrostatic latent image forming process mechanism). When the photosensitive bodies or the developers are consumed, users themselves can perform action such as replacement of the photosensitive bodies and supply of the developers without depending on professional servicemen by employing the process cartridge system, which significantly improves the operability.

However, the service life of such process cartridges is determined by the frequency in use or the like, and thus, the states of the process cartridges such as the frequency in use need to be grasped and controlled. Therefore, a nonvolatile memory (read-only memory (ROM)) is mounted as a recording medium on a process cartridge disclosed in Japanese Patent Application Laid-open No. 2008-185971 or the like. The nonvolatile memory stores therein the amount used in the main body of the image forming apparatus. The application limit of the process cartridge is judged according to the information, and the replacement timing is informed to users. With such functions and objects, the main body of the image forming apparatus accesses the nonvolatile memory of the process cartridge at timing before and after image formation or after replacement of the process cartridge or similar timing.

As illustrated in FIG. 9, with this structure, an apparatus casing 100 of the main body of the apparatus includes a contact terminal 102, and a process cartridge 103 includes a recording medium 101 including a nonvolatile memory. The recording medium 101 generally slightly protrudes from a side surface 103*a* of the process cartridge 103.

As illustrated in FIG. 10, when the process cartridge 103 is mounted on the main body of the apparatus, the process cartridge 103 is inserted into the apparatus casing 100 along an arrow A direction. In other words, the process cartridge 103 is inserted along the arrow A direction while the side surface 103*a* of the process cartridge 103 in which the recording medium 101 is installed and an internal surface 100*a* of the apparatus casing 100 in which the contact terminal 102 is installed are maintained in a parallel state.

Some conventional inkjet printers include a circuit board that includes a storage unit recording information and a contact terminal connecting an external circuit with the storage unit and that is included in the main body of a container (Japanese Patent Application Laid-open No. 2007-237657). With this structure, the circuit board is maintained in an elastically displaceable manner that the contact terminal has a specified pressing load on a contact terminal provided at a container mounting part side.

As illustrated in FIG. 9 or similar figures, when the process cartridge 103 is inserted, the contact terminal 102 slides on the resist of the recording medium 101. However, abrasion powder may be generated by such sliding and may adhere to the contact terminal 102. The abrasion powder adhering to the contact terminal 102 may cause contact failure between the contact terminal 102 and the recording medium 101, failure of the contact terminal 102 due to the contact, and similar failure.

Moreover, even when the circuit board is maintained in an elastically displaceable manner as with the inkjet printer disclosed in Japanese Patent Application Laid-open No. 2007-237657, the contact terminal is supposed to be in sliding contact with (slide on) the contact terminal of the circuit board during the placement. Therefore, although the abrasion decreases to an extent, it will still occur. Accordingly, this structure has the same disadvantages as those illustrated in FIG. 9 or similar figures.

With the image forming apparatus of the present invention, when the process cartridge is inserted into the main body of the apparatus, the protruding portion of the contact terminal is in sliding contact with the slide contact surface portion of the process cartridge. During the sliding, the protruding portion is pressed in a direction of being apart from the recording medium to limit contact between the contact terminal and the recording medium. When the process cartridge reaches its predetermined mounted position, the protruding portion fits in a fitting concave portion, and the contact restriction of the contact terminal with the recording medium is released. Accordingly, the contact terminal comes in contact with the recording medium. On the other hand, when the process cartridge is in action of being taken out from the main body of the apparatus, the protruding portion of the contact terminal is in sliding contact with the slide contact surface portion of the process cartridge. During the sliding, the protruding portion is pressed in a direction of being apart from the recording medium to limit contact between the contact terminal and the recording medium.

Accordingly, in the image forming apparatus, the contact terminal comes in contact with the recording medium only when the protruding portion is in a state of fitting in the fitting concave portion. While the contact terminal comes in contact with the recording medium, no sliding occurs. Moreover, both the contact terminal side and the recording medium side are not abraded during the action of inserting and taking out the process cartridge.

Thus, the structure can be simplified by constituting the contact terminal with the plate spring member.

The cam member is replaceable when the protruding portion is formed of the cam member different from the member for the main body portion.

Thus, when the contact terminal includes the elastic member, the contact portion of the contact terminal can be pressed to the recording medium side, which enables the contact pressure between the contact portion of the contact terminal and the recording medium to be stabilized.

The contact reliability between the contact terminal and the recording medium can be improved by including the contact portion in plurality.

With such a structure, the protruding portion (cam member) can share the contact portion in plurality.

SUMMARY OF THE INVENTION

It is an object of the present invention to at least partially solve the problems in the conventional technology.

According to an aspect of the present invention, there is provided an image forming apparatus in which a process cartridge having an image carrier is detachably mounted on a main body of the apparatus and in which a recording medium for obtaining process cartridge state information is installed in the process cartridge to be physically in contact with a contact terminal provided at the main body of the apparatus, the image forming apparatus including a protruding portion that is provided at the contact terminal and that protrudes further toward the process cartridge than a contact portion coming in contact with the recording medium; a slide contact surface portion that is provided at a side surface of the process cartridge and that is in sliding contact with the protruding portion during action of inserting and taking out the process cartridge into and from the main body of the apparatus; and a fitting concave portion that is provided at the side surface of the process cartridge and in which the protruding portion fits, wherein the slide contact surface portion is in a state of being in sliding contact with the protruding portion of the contact terminal by action of inserting the process cartridge at a predetermined mounted position, and the protruding portion is pressed in a direction being apart from the recording medium to limit contact between the contact terminal and the recording medium, the protruding portion fits in the fitting concave portion at the predetermined mounted position to make the contact terminal come in contact with the recording medium, and the protruding portion is pulled out from the fitting concave portion by action of taking out the process cartridge from a state where the process cartridge is fixed at the predetermined mounted position to be in sliding contact with the slide contact surface portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are described below with reference to the accompanying drawings.

Figure 1:
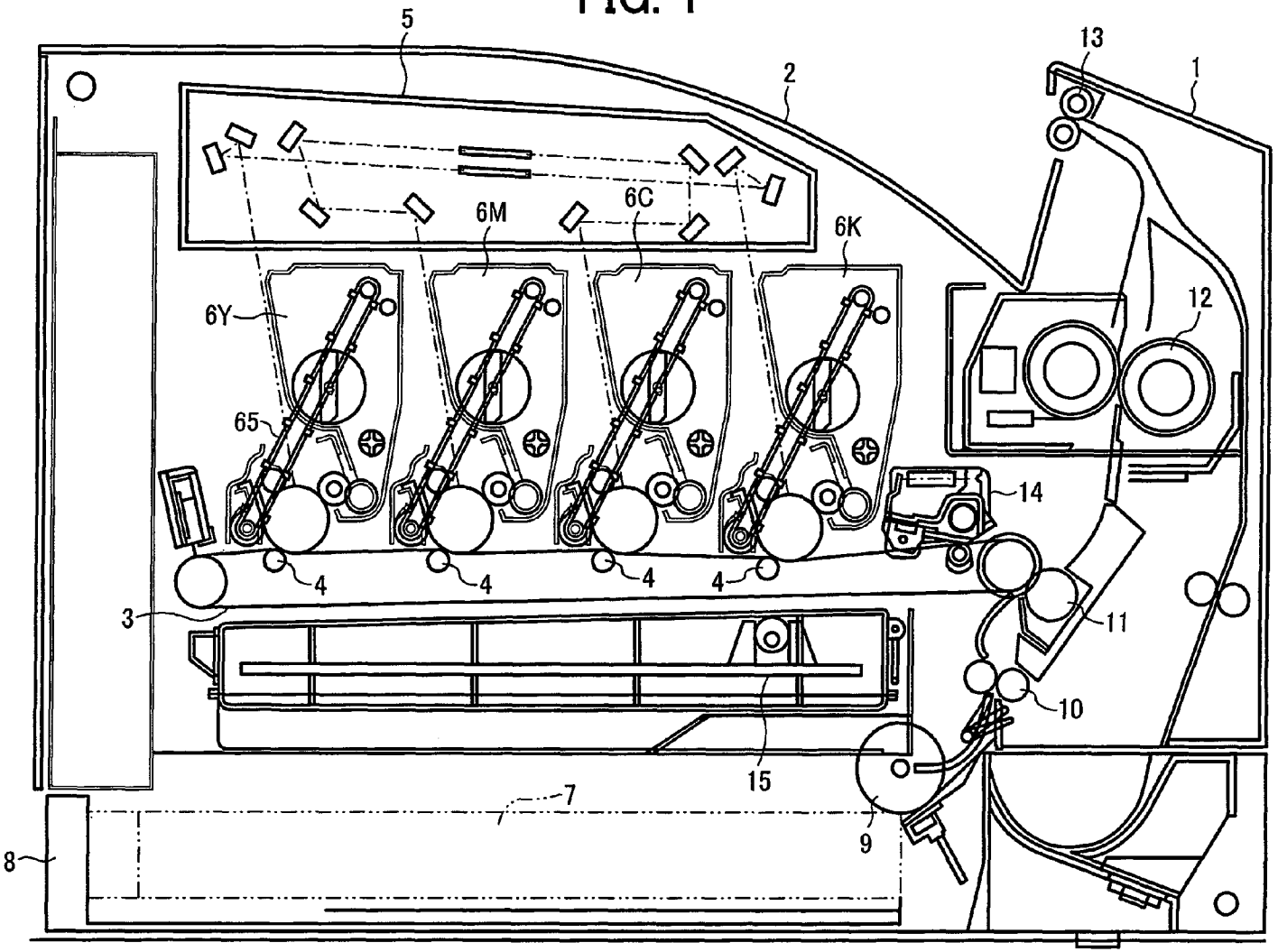
FIG. 1 is a schematic diagram of the whole structure of an image forming apparatus according to an embodiment of the present invention.

FIG. 1 is a cross-sectional schematic diagram of a color printer that is an example of an image forming apparatus according to the present invention. The color printer illustrated in FIG. 1 is a color printer that employs a tandem system and is capable of forming images in full color. Four process cartridges 6Y, 6M, 6C, 6K are arranged at substantially a central portion of the main body of the apparatus. An exposure device 5 for forming latent images on photosensitive drums of the process cartridges 6Y, 6M, 6C, 6K is arranged above the process cartridges.

A driving roller 23, a driven roller 24, and an intermediate transfer belt 3 wrapped around a plurality of primary transfer rollers 4 as an intermediate transfer unit are arranged below the process cartridges 6Y, 6M, 6C, 6K. A second transfer device 11 and an intermediate transfer body cleaning device 14 are arranged at the right side of the intermediate transfer belt 3 as viewed in FIG. 1. A used toner recovery container 15 for the transfer belt and a paper feed cassette 8 that is loaded with and accommodates a recording medium 7 are arranged below the intermediate transfer belt 3. The recording medium 7 fed by a feeding roller 9 passes through between the intermediate transfer belt 3 and the second transfer device 11 and is guided to a fixing device 12, and thus, toner images are thermally fixed on the recording medium 7.

The process cartridges 6Y, 6M, 6C, 6K in FIG. 1 form toner images in different colors of yellow, magenta, cyan, and black, but their structures and action for forming the toner images are all the same. Therefore, a process cartridge 6 is described in FIG. 2 without using Y, M, C, and K.

A photosensitive drum 61 as a photosensitive body is arranged so as to face the intermediate transfer belt 3 (see FIG. 1) below the process cartridge 6 and is driven in rotation in a clockwise direction CW (the rotation in the clockwise direction CW is positive rotation) during image formation. In this embodiment, the photosensitive body is represented as a cylindrical shape but may be an endless belt. A cleaning blade 62 as a cleaning device that scrapes off residual toner after the primary transfer and a charging roller 63 as a charging device that comes in contact with the photosensitive drum 61 are arranged around the photosensitive drum 61.

A toner conveying coil 64 that conveys the toner scraped as used toner horizontally is arranged near the cleaning blade 62. Thus, horizontally transferred used toner is scooped up by a conveying belt 65 and is recovered in a used toner recovery chamber 66 of a developing device 50. The central area of a developing device 16 partitioned from the used toner recovery chamber 66 by the use of a partitioning member 68 formed of a material with plasticity such as a film is an unused toner chamber 67. Toner in a predetermined color fills the unused toner chamber 67.

The developing device 16 includes a developing roller 51, an agitator 52 for agitating undeveloped toner, a toner supply roller 53 for supplying toner to the developing roller, and a developing blade 54 for limiting a toner amount on the developing roller in a predetermined amount. The developing roller 51 is arranged so as to have a narrow gap with or be in contact with the photosensitive drum 61.

Figure 2:
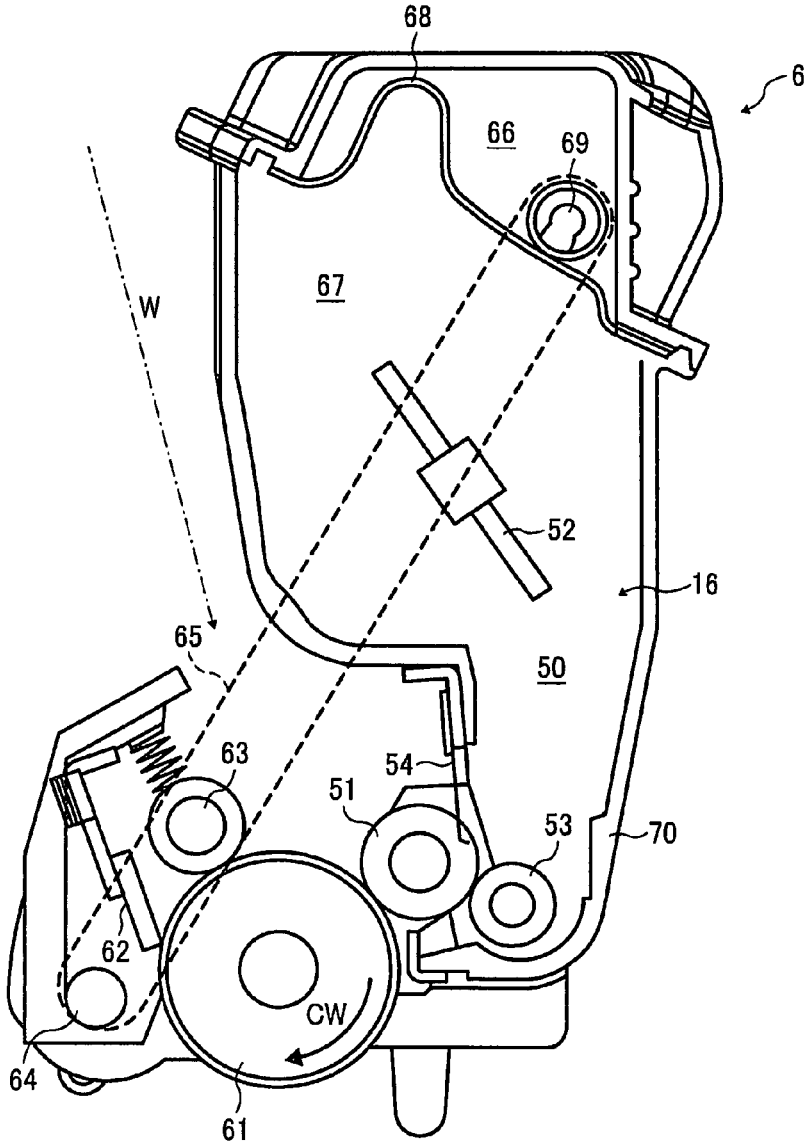
FIG. 2 is a schematic diagram of a substantial portion of a process cartridge for the image forming apparatus.

An electrophotographic image formation process will be described. In FIG. 2, the photosensitive drum 61 positively rotates by a driving device (not illustrated) installed in the main body of the image forming apparatus, and the surface photosensitive layer is charged to a uniform high potential by the charging roller 63. The uniformly charged photosensitive layer is selectively exposed to light according to image data from an arrow direction W by the exposure device 5. An electrostatic latent image including a low potential portion where the potential is lowered by this exposure and a high potential portion due to initialization is formed.

When the low potential portion (or the high potential portion) of the electrostatic latent image reaches a position where the photosensitive drum faces the developing roller, toner is transferred from the surface of the developing roller 51 on which a toner thin layer is formed to form (develop) a toner image. After the primary transfer described later, the cleaning blade 62 being in contact with the photosensitive drum 61 cleans the toner remaining on the surface of the photosensitive drum 61. A neutralizing device (not illustrated) removes charges remaining on the surface of the drum to prepare for the subsequent toner image formation.

Referring back to FIG. 1, the primary transfer rollers 4 for primary transfer are arranged at positions where more than one such process cartridge 6 comes in contact with the transfer belt 3. A potential difference is created between the photosensitive drum 61 and the transfer belt 3 by applying a high potential to the primary transfer rollers 4 to transfer the toner image formed on the surface of the photosensitive drum 61. The process cartridges 6 transfer toner images in each color to the transfer belt 3 subsequently, and a color toner image in a plurality of colors in which the monochromatic toner images are superimposed is formed on the transfer belt 3.

Meanwhile, the recording medium 7 such as paper is fed from the feeding roller 9 and a paper conveying device 10 to the second transfer device 11 at proper timing. The toner image (the monochromatic toner image in some cases) formed on the surface of the transfer belt 3 is transferred onto the recording medium 7 by creating a potential difference between the transfer belt 3 and the second transfer device 11 by applying a high potential to the second transfer device 11.

The recording medium 7 onto which the toner image is transferred is separated from the transfer belt 3, and the toner image is melted and fixed onto the recording medium 7 by the fixing device 12. The recording medium 7 is then discharged into an output tray 2 at the top surface of the printer housing via paper discharging roller pairs 13. Excess toner remaining on the surface of the transfer belt 3 after the toner image is transferred to the recording medium 7 is cleaned off by the intermediate transfer body cleaning device 14 (a rubber blade is typically used as with the cleaning device for the photosensitive body) and recovered into the used toner recovery container 15. The cleaned transfer belt 3 is then made ready for transfer of the subsequent toner image.

When the image forming operation as described above is repeated for a long period, paper powder adhering to the recording medium 7 such as paper adheres onto the transfer belt 3 and is deposited at edges of the intermediate transfer body cleaning device and the cleaning blade 62. This causes a phenomenon in which paper powder is caught at a contact portion between the transfer belt 3 and the intermediate transfer body cleaning device or a contact portion between the photosensitive drum 61 and the cleaning blade 62. Because the size of the paper powder is larger than the particle diameter of toner, a contact state between the cleaning blade and the photosensitive body (or the transfer belt) becomes non-uniform near the place where the paper powder is caught by the end of the cleaning blade, which may cause cleaning failure. For preventing this phenomenon, a motor (not illustrated) as a driving source of the image forming apparatus is rotated backward every predetermined number of printed sheets and thus rotates the photosensitive body in the direction opposite to the arrow CW (rotates backward). As a result, the caught paper powder is ejected, and favorable cleaning properties can be maintained.

The process cartridge 6 in an embodiment of the present invention described below works with the photosensitive drum 61, the developing device 50, the charging roller 63, and the cleaning blade 62 as an integrated process cartridge. The developing device 50 is constituted as a separate independent unit. When toner in the unused toner chamber 67 of the developing device 50 is in a toner end condition, the process cartridge 6 or the developing device 50 needs to be replaced with a new unit or the like.

Figure 3:
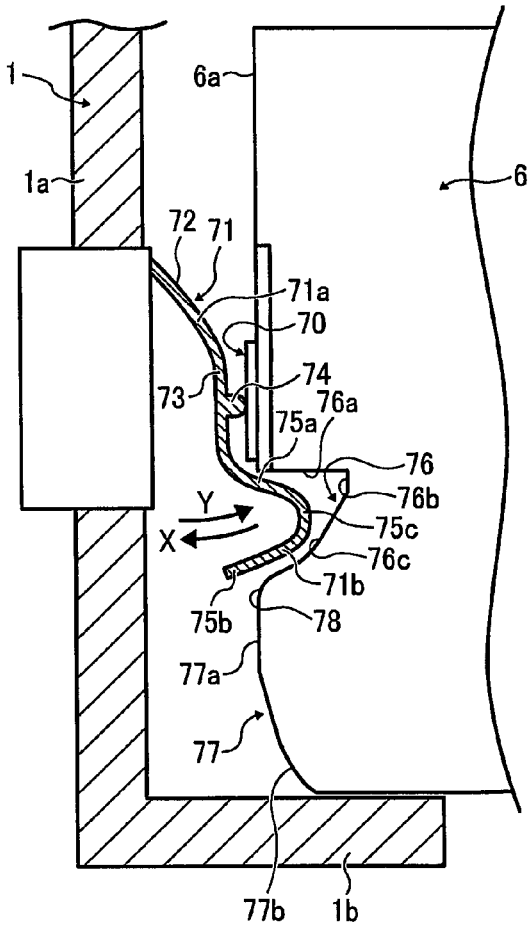
FIG. 3 is a schematic diagram in a state where the process cartridge is mounted at a predetermined mounted position.

Therefore, as illustrated in FIG. 3, a recording medium 70 including a nonvolatile memory (read-only memory (ROM)) (semiconductor memory capable of preserving memory contents even when power is off) or similar memories is installed at a side surface 6*a* of the process cartridge 6 in order to grasp and control the process cartridge condition such as the frequency in use of the process cartridge 6. A contact terminal 71 is provided at an apparatus casing 1 side, that is, a wall 1*a* that opposes the recording medium 70 of the process cartridge 6.

The recording medium 70 stores the amount used in the main body of the image forming apparatus in this nonvolatile memory, and the contact terminal 71 comes in contact with the recording medium 70. According to thus obtained information, the application limit of the process cartridge 6 is judged, and the replacement timing is informed to users.

The contact terminal 71 is formed of a plate spring member and includes a main body portion 71*a* and a protruding portion 71*b* continuously formed from the lower end of the main body portion 71*a*. The main body portion 71*a* includes a first portion 72 that extends diagonally from the wall 1*a* and a second portion 73 that extends from the first portion 72 in parallel with the wall 1*a*. A contact portion 74 protruding to the inside of the apparatus is provided at the second portion 73.

The section of the protruding portion 71*b* is formed in an U-shape. In other words, the protruding portion 71*b* includes a pair of inclined portions 75*a*, 75*b* that approach the process cartridge side and a convex curved portion 75*c* connecting the inclined portions 75*a*, 75*b*. In the state illustrated in FIG. 3, when the convex curved portion 75*c* is pressed to the wall 1*a* side, the contact terminal 71 elastically swings (bents) in an arrow X direction with the side opposed to the protruding portion of the main body portion 71*a* as a fulcrum. In contrast, when the pressing force is released, the contact terminal 71 swings in an arrow Y direction to be returned to its original state.

A fitting concave portion 76 in which the protruding portion 71*b* fits and a slide contact surface portion 77 in sliding contact with the protruding portion 71*b* during the action of inserting and taking out the process cartridge 6 are provided at the side surface 6*a* of the process cartridge 6.

The fitting concave portion 76 includes a plane portion 76*a* that extends in a direction orthogonal to the wall 1*a* at the recording medium side, a flat surface 76*b* that extends from the bottom portion of the plane portion 76*a* and is orthogonal to the plane portion 76*a*, and a concave curved surface 76*c* that extends from the flat surface 76*b*.

The slide contact surface portion 77 serves as a guide surface that is in sliding contact with the protruding portion 71*b* and guides the protruding portion 71*b* to fitting in the fitting concave portion 76 by the action of inserting the process cartridge 6. On the other hand, by the action of taking out the process cartridge 6, the protruding portion 71*b* is pulled out from the fitting concave portion 76, and the guide surface is in sliding contact with the protruding portion 71*b*.

Therefore, the slide contact surface portion 77 includes a first portion 77*a* in parallel to the wall 1*a* and a second portion 77*b* having a convex arc portion extending from the first portion 77*a* to the side opposed to the recording medium. A round portion 78 is provided at a corner between the first portion 77*a* of the slide contact surface portion 77 and the concave curved surface 76*c* of the fitting concave portion 76. In such a manner, the fitting concave portion 76 is continuously formed at a position between the slide contact surface portion 77 and the recording medium 70.

Figure 4:
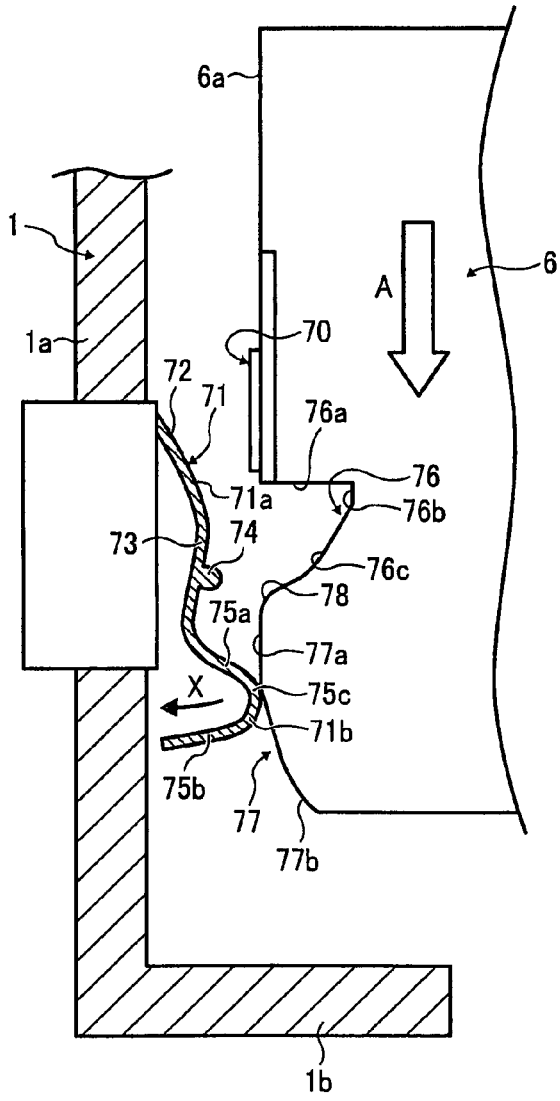
FIG. 4 is a schematic diagram for illustrating a method of inserting the process cartridge at the predetermined mounted position.

As illustrated in FIG. 4, when such a process cartridge 6 is mounted on this apparatus, the process cartridge 6 is inserted to a wall 1*b* side orthogonal to the wall 1*a* as indicated by an arrow A while the wall 1*a* of the apparatus casing 1 and the side surface 6*a* of the process cartridge 6 are maintained in a parallel state.

While the process cartridge 6 is inserted in the arrow A direction, the protruding portion 71*b* is in sliding contact with the second portion 77*b* of the slide contact surface portion 77. Subsequently, when the process cartridge 6 is further inserted in the arrow A direction, the protruding portion 71*b* is in sliding contact with the first portion 77*a* of the slide contact surface portion 77. In other words, the convex curved portion 75*c* of the protruding portion 71*b* is in sliding contact with the second portion 77*b* and the first portion 77*a* of the slide contact surface portion 77 sequentially. The protruding portion 71*b* is thus pressed in the arrow X direction in such a sliding contact state.

In this state, the contact portion 74 of the contact terminal 71 is positioned closer to the wall 1*a* side than the recording medium 70 and thus does not come in contact with the recording medium 70. The process cartridge 6 is further inserted in the A direction to be in a state where the fitting concave portion 76 corresponds to the protruding portion 71*b*. When the fitting concave portion 76 corresponds to the protruding portion 71*b*, the protruding portion 71*b* is released from the pressing force of the slide contact surface portion 77 in the arrow X direction. Releasing this pressing force makes the contact terminal 71 bent to swing the protruding portion 71*b* in the arrow Y direction, and thus, the protruding portion 71*b* fits in the fitting concave portion 76 as illustrated in FIG. 3.

In a state where the protruding portion 71*b* fits in the fitting concave portion 76, the contact portion 74 of the contact terminal 71 comes in contact with the recording medium 70 due to its elastic force. Such a state where the protruding portion 71*b* fits in the fitting concave portion 76 is a state where the process cartridge 6 is fixed (set) at a predetermined mounted position. The information stored in the recording medium 70 can be read by bringing the contact portion 74 into contact with the recording medium 70. By reading the information stored in the recording medium 70 in such a manner, the application limit of the process cartridge 6 can be judged, and the replacement timing can be informed to users according to the information.

Figure 5:
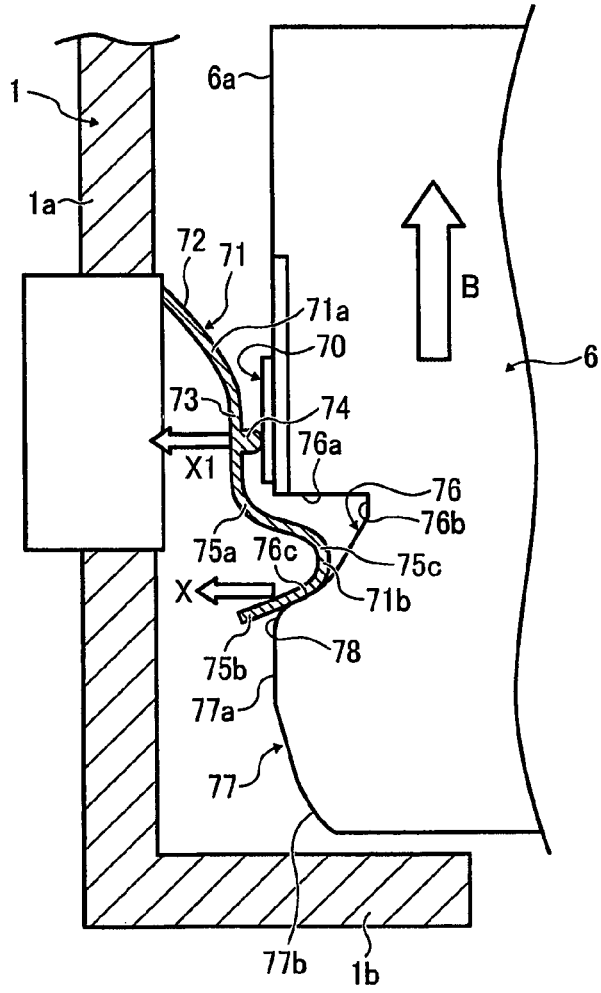
FIG. 5 is a schematic diagram for illustrating a method of taking out the process cartridge from the predetermined mounted position.

As illustrated in FIG. 5, when the process cartridge 6 is taken out from the state of being fixed (set) at the predetermined mounted position as illustrated in FIG. 3, the process cartridge 6 is pulled out as indicated by an arrow B with the wall 1*a* of the apparatus casing 1 and the side surface 6*a* of the process cartridge 6 being maintained in a parallel state.

As illustrated in FIG. 5, while the process cartridge 6 is pulled out as indicated by the arrow B, the inclined portion 75*b* of the protruding portion 71*b* comes in contact with the concave curved surface 76*c* of the fitting concave portion 76. The process cartridge 6 is further pulled out from this state in the arrow B direction. By pulling out the process cartridge 6 in the arrow B direction, the protruding portion 71*b* is pressed in the arrow X direction because the inclined portion 75*b* and the concave curved surface 76*c* are directed to the wall 1*a* side and incline to the wall 1*b* side (wall orthogonal to the wall 1*a*). The contact portion 74 of the contact terminal 71 swings in an arrow X1 direction during the pressing and is apart from the recording medium 70.

When the process cartridge 6 is further pulled out as indicated by the arrow B from the state illustrated in FIG. 5, the protruding portion 71*b* of the contact terminal 71 is in a state of being out of the fitting concave portion 76 and is in a state where the first portion 77*a* of the slide contact surface portion 77 corresponds to the protruding portion 71*b*. In other words, the protruding portion 71*b* becomes in the state illustrated in FIG. 4. When the protruding portion 71*b* becomes in the state illustrated in FIG. 4, the contact portion 74 of the contact terminal 71 is apart from the recording medium 70, which allows the process cartridge 6 to be taken out.

Accordingly, the protruding portion 71*b*, the fitting concave portion 76, and the slide contact surface portion 77 are set to be in shapes and sizes that realize the following conditions. When the protruding portion 71*b* slides on the slide contact surface portion 77 and fits in the fitting concave portion 76, the contact portion 74 of the contact terminal 71 does not slide on the recording medium 70. Moreover, when the protruding portion 71*b* moves from its state of fitting in the fitting concave portion 76 to the slide contact surface portion 77, the contact portion 74 of the contact terminal 71 does also not slide on the recording medium 70.

With the image forming apparatus of the present invention, when the process cartridge 6 is inserted into the main body of the apparatus, the protruding portion 71*b* of the contact terminal 71 is in sliding contact with the slide contact surface portion 77 of the process cartridge 6. During the sliding, the protruding portion 71*b* is pressed in a direction of being apart from the recording medium 70 to limit contact between the contact terminal 71 and the recording medium 70. When the process cartridge 6 reaches its predetermined mounted position, the protruding portion 71*b* fits in the fitting concave portion 76, and the contact restriction of the contact terminal 71 with the recording medium 70 is released. Accordingly, the contact terminal 71 comes in contact with the recording medium 70. On the other hand, when the process cartridge 6 is in action of being taken out from the main body of the apparatus, the protruding portion 71*b* of the contact terminal is in sliding contact with the slide contact surface portion 77 of the process cartridge 6. During the sliding, the protruding portion 71*b* is pressed in a direction of being apart from the recording medium 70 to limit contact of the contact terminal 71 with the recording medium 70.

Accordingly, in the image forming apparatus, the contact terminal 71 comes in contact with the recording medium 70 only when the protruding portion 71*b* is in a state of fitting in the fitting concave portion 76. While the contact terminal 71 comes in contact with the recording medium 70, no sliding occurs. Moreover, during the action of inserting and taking out the process cartridge 6, both the contact terminal side and the recording medium 70 side are not abraded. As a result, contact failure due to adhesion of foreign matters or the like can be prevented, and the replacement timing for the process cartridge 6 can be stably and precisely detected, which enables images to be stably formed for a long period.

The protruding portion 71*b* can be pulled out from the fitting concave portion 76 by the action of taking out the process cartridge 6. Therefore, the process cartridge 6 can be stably inserted and taken out, and thus, the replacement operation and similar operations for the process cartridge 6 can be performed stably and promptly. In the embodiment described above, a slide contact portion of the protruding portion 71*b* of the contact terminal 71 that comes in contact with the slide contact surface portion 77 is the convex curved portion 75*c*, and therefore, the protruding portion 71*b* is in sliding contact with the slide contact surface portion 77 smoothly. As a result, abrasion, damage, and similar failure of the slide contact surface portion 77 and the protruding portion 71*b* can be effectively prevented.

The contact terminal 71 is formed of a plate spring member, and thus, the structure can be simplified to realize cost reduction. Moreover, even with such a simple structure, the contact terminal 71 can exert stable elastic force to realize improvement of reliability to the recording medium.

Figure 6:
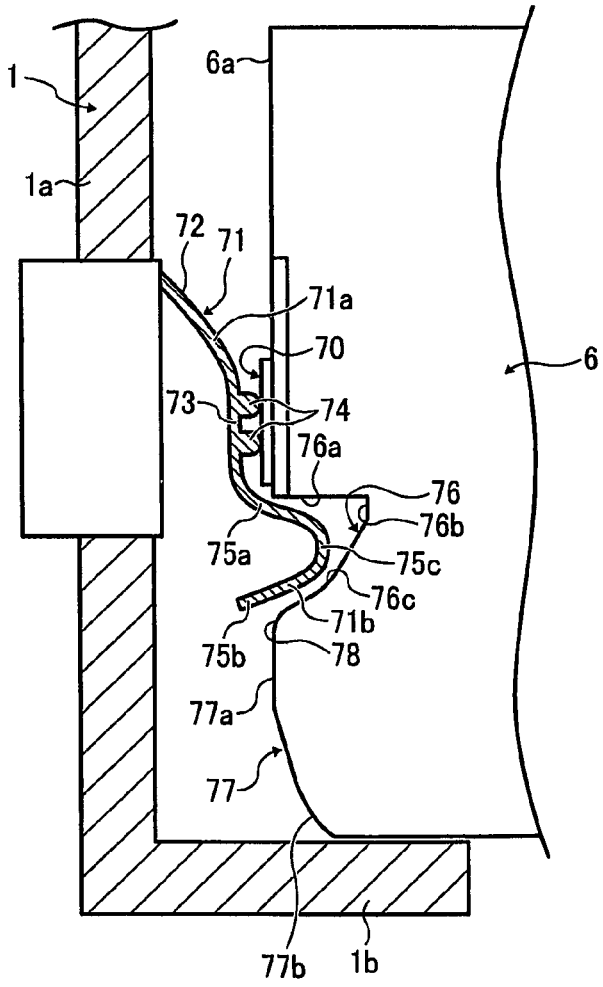
FIG. 6 is a schematic diagram in a state where the process cartridge for the image forming apparatus employing another contact terminal is mounted at the predetermined mounted position.

As illustrated in FIG. 6, the contact terminal 71 may include the contact portion 74 in plurality. The structures of the contact terminal 71, the fitting concave portion 76, the slide contact surface portion 77, and the like in FIG. 6 are the same as those illustrated in FIG. 3 or similar figures. Therefore, the components having the same structures with those in FIG. 3 and similar figures are given with the same reference numerals to omit the description of the components.

Accordingly, the components illustrated in FIG. 6 also have the same action effects as those illustrated in FIG. 3 or similar figures. Moreover, by having the contact portion 74 in plurality, even when contact failure occurs in one of the contact portions due to foreign matters or the like, the other contact portions 74 can come in contact with the recording medium 70. Therefore, contact failure unlikely occurs as a whole, which can improve contact reliability between the contact terminal 71 and the recording medium 70. When the number of contact portions 74 is increased, the contact portions 74 are provided along the longitudinal direction of the contact terminal 71 in FIG. 6. However, the contact portions 74 may be provided along the width direction orthogonal to the longitudinal direction or along both the longitudinal direction and the width direction. The number of contact terminals 71 is also optional.

Figure 7:
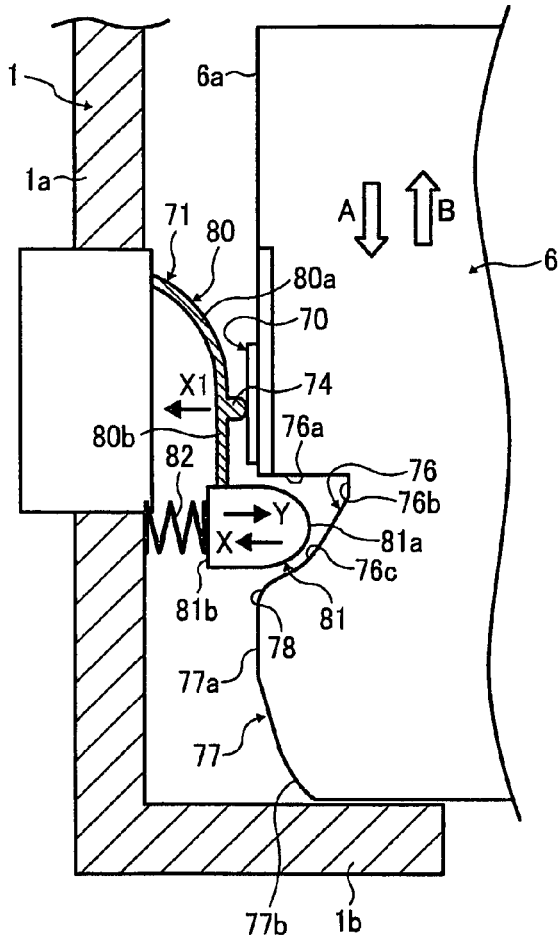
FIG. 7 is a schematic diagram in a state where the process cartridge for the image forming apparatus employing still another contact terminal is mounted at the predetermined mounted position.

FIG. 7 is a modified example of the contact terminal 71. The contact terminal 71 in this example includes a main body portion 80 formed of a plate spring member and a protruding portion 81 provided at the main body portion 80. In a state where the protruding portion 81 fits in the fitting concave portion 76, a first portion 80*a* as a curved portion and a second portion 80*b* that is continuously provided from the first portion 80*a* and is in substantially parallel to the wall 1*a* are formed in the main body portion 80. In this state, the contact portion 74 provided at the main body portion 80 elastically comes in contact with the recording medium 70.

The protruding portion 81 is formed of a cam member that includes an arc portion 81*a* at the end, that is, has a so-called bullet shape. An elastic member 82 formed of a coil spring or the like is provided at a facet 81*b* of the protruding portion 81. The elastic member 82 can press the protruding portion 81 in the arrow Y direction to be in a state where the protruding portion 81 corresponds to the fitting concave portion 76. Accordingly, the protruding portion 81 fits in the fitting concave portion 76. The protruding portion 81 is preferably made of a nonconductive material.

Therefore, the use of such a contact terminal 71 also functions as with when the contact terminal 71 illustrated in FIG. 3 or similar figures is used. In other words, when the process cartridge 6 is inserted, the arc portion 81*a* of the protruding portion 81 is in sliding contact with the second portion 77*b* and the first portion 77*a* of the slide contact surface portion 77 sequentially. The protruding portion 81 is thus pressed in the arrow X direction in such a sliding contact state.

In this state, the contact portion 74 of the contact terminal 71 is positioned closer to the wall 1*a* side than the recording medium 70 and thus does not come in contact with the recording medium 70. The process cartridge 6 is further inserted in the arrow A direction to be in a state where the fitting concave portion 76 corresponds to the protruding portion 81. When the fitting concave portion 76 corresponds to the protruding portion 81, the protruding portion 81 is released from the pressing force of the slide contact surface portion 77 in the arrow X direction. Releasing this pressing force makes the protruding portion 81 swing in the arrow Y direction, and thus, the protruding portion 81 fits in the fitting concave portion 76.

As illustrated in FIG. 7, when the process cartridge 6 is taken out from the state of being fixed (set) at a predetermined mounted position, the process cartridge 6 is pulled out as indicated by the arrow B with the wall 1*a* of the apparatus casing 1 and the side surface 6*a* of the process cartridge 6 being maintained in a parallel state.

By pulling out the process cartridge 6 as indicated by the arrow B in such a manner, the arc portion 81*a* of the protruding portion 81 comes in contact with the concave curved surface 76*c* of the fitting concave portion 76. When the process cartridge 6 is further pulled out in the arrow B direction, the main body portion 80 bents, and the arc portion 81*a* slides on the concave curved surface 76*c* of the fitting concave portion 76 to press the protruding portion 81 in the arrow X direction. The contact portion 74 of the contact terminal 71 swings in the arrow X1 direction during the pressing and is apart from the recording medium 70.

When the process cartridge 6 is further pulled out as indicated by the arrow B, the protruding portion 81 of the contact terminal 71 is in a state of being out of the fitting concave portion 76 and is in a state where the first portion 77*a* of the slide contact surface portion 77 corresponds to the protruding portion 81. As a result, the contact portion 74 of the contact terminal 71 is apart from the recording medium 70, which allows the process cartridge 6 to be taken out.

Therefore, the use of the contact terminal 71 illustrated in FIG. 7 also exerts action effects as with when the contact terminal 71 illustrated in FIG. 3 or similar figures is used. Particularly, the cam member is replaceable when the protruding portion 81 is formed of a cam member different from the member for the main body portion 80. Therefore, when the cam member is damaged, only the cam member can be replaced without replacing the whole of the contact terminal to achieve cost reduction. The cam member does not need to have elasticity and thus can employ a material excellent in lubricity. Such a material excellent in lubricity enables the process cartridge 6 to be inserted and taken out smoothly, and therefore, the process cartridge 6 can be stably replaced.

The contact portion 74 of the contact terminal 71 can be pressed to the recording medium 70 side so long as the elastic member 82 that presses the contact portion 74 of the contact terminal 71 to the recording medium 70 side is provided. Therefore, the contact pressure between the contact portion 74 of the contact terminal 71 and the recording medium 70 can be stabilized.

Figure 8:
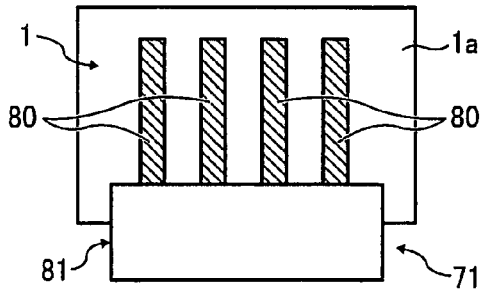
FIG. 8 is a schematic diagram of still another contact terminal.
Figure 9:
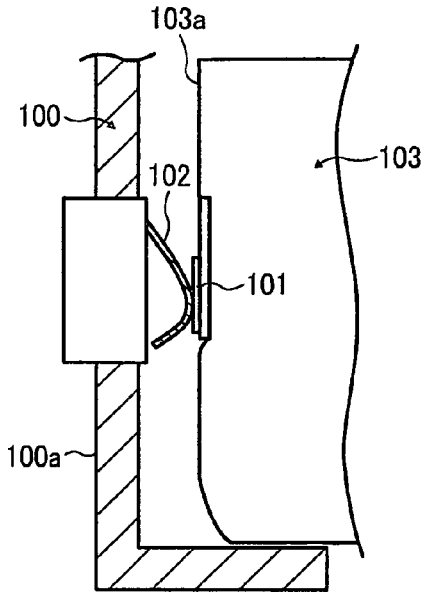
FIG. 9 is a schematic diagram in a state where a process cartridge for a conventional image forming apparatus is mounted at a predetermined mounted position.
Figure 10:
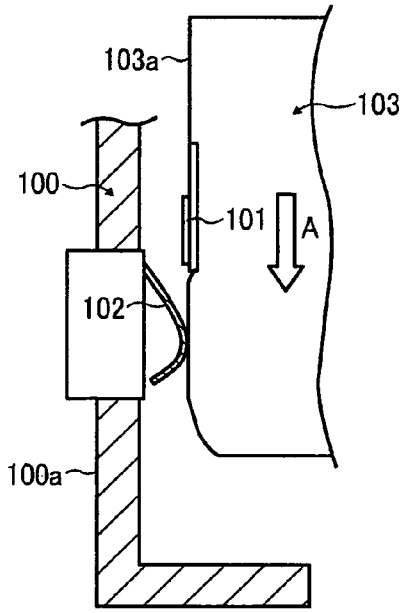
FIG. 10 is a schematic diagram for illustrating a method of mounting the process cartridge for the conventional image forming apparatus at the predetermined mounted position.

In FIG. 8, contact restriction and release from the contact restriction for a plurality of contact portions is performed with one cam member. In other words, the main body portion 80 is installed in plurality at the protruding portion 81 formed of the cam member. When the recording medium 70 is arranged in plurality, the main body portion 80 provided in plurality can share the protruding portion 81 formed of the cam member. Accordingly, the number of components can be reduced to achieve cost reduction. The protruding portion 81 is also preferably made of a nonconductive material.

The present invention is not limited by the embodiments described above. Changes and modifications can be made appropriately without departing from the spirit and scope of the present invention. Examples of the image forming apparatus according to the present invention include an electrophotographic copier, a laser beam printer, and a facsimile. The recording medium may be besides a nonvolatile memory, a magnetic recording medium, an optical recording medium, and similar recording media. Although the slide contact surface portion 77 includes the first portion 77*a* and the second portion 77*b* in the embodiment described above, the slide contact surface portion 77 may include one curved surface, one inclined surface, two or more curved surfaces, or the like, except for such a first portion 77*a* and a second portion 77*b*. The cross-section shape of the fitting concave portion 76 is also not limited to the cross-section shape illustrated in FIG. 3 or similar figures. Any shapes may be applicable so long as the following conditions are satisfied. The protruding portions 71*b*, 81 are guided to the slide contact surface portion 77 while the process cartridge 6 is inserted and are fit in the fitting concave portion 76. The protruding portions 71*b*, 81 are pulled out from the fitting concave portion 76 while the process cartridge 6 is taken out from the state where the protruding portions 71*b*, 81 are fit in the fitting concave portion 76 and are in sliding contact with the slide contact surface portion 77.

According to the present invention, both the contact terminal side and the recording medium side are not abraded during the action of inserting and taking out the process cartridge. As a result, contact failure due to adhesion of foreign matters or the like can be prevented, and the replacement timing for the process cartridge can be stably and precisely detected, which enables images to be stably formed for a long period.

By the action of inserting the process cartridge, the protruding portion can fit in the fitting concave portion, and by the action of taking out the process cartridge, the protruding portion can be pulled out from the fitting concave portion. Therefore, the process cartridge can be stably inserted and taken out, and thus, the replacement operation and similar operations for the process cartridge can be performed stably and promptly.

The contact terminal is formed of a plate spring member, and thus, the structure can be simplified to realize cost reduction. Moreover, even with such a simple structure, the contact terminal can exert stable elastic force to realize improvement of reliability to the recording medium. The cam member is replaceable when the protruding portion is formed of a cam member different from the member for the main body portion. Therefore, when the cam member is damaged or in a similar condition, only the cam member can be replaced without replacing the whole of the contact terminal to achieve cost reduction. The cam member does not need to have elasticity and thus can employ a material excellent in lubricity. Such a material excellent in lubricity enables the process cartridge to be inserted and taken out smoothly. Therefore, the process cartridge can be stably replaced, and the abrasion of the process cartridge, the failure of the contact terminal, and similar failure can be prevented.

When the contact terminal includes an elastic member that presses the contact portion of the contact terminal to the recording medium side, the contact portion of the contact terminal can be pressed to the recording medium side, which enables the contact pressure between the contact portion of the contact terminal and the recording medium to be stabilized.

With the contact terminal having a plurality of contact portions that comes in contact with the recording medium, even when contact failure occurs in one of the contact portions due to foreign matters or the like, the other contact portions can come in contact with the recording medium. Therefore, contact failure unlikely occurs as a whole, which can improve contact reliability between the contact terminal and the recording medium.

The contact portions that share the protruding portion (cam member) can improve contact reliability between the contact terminal and the recording medium. Accordingly, the number of components can be reduced to achieve cost reduction and structure simplification.

Although the invention has been described with respect to specific embodiments for a complete and clear disclosure, the appended claims are not to be thus limited but are to be construed as embodying all modifications and alternative constructions that may occur to one skilled the art that fairly fall within the basic teaching herein set forth.

What is claimed is:

1. An image forming apparatus in which a process cartridge having an image carrier is detachably mounted from a main body of the apparatus and in which a recording medium for obtaining process cartridge state information is provided in the process cartridge to be physically in contact with a contact terminal provided at the main body of the apparatus, the image forming apparatus comprising:

a protruding portion that is provided at the contact terminal and that protrudes further toward the process cartridge than a contact portion coming in contact with the recording medium;

a slide contact surface portion that is provided at a side surface of the process cartridge and that is in sliding contact with the protruding portion during action of inserting and taking out the process cartridge into and from the main body of the apparatus; and a fitting concave portion that is provided at the side surface of the process cartridge and in which the protruding portion fits, wherein the slide contact surface portion is in a state of being in sliding contact with the protruding portion of the contact terminal via an action of inserting the process cartridge at a mounted position, and the protruding portion is pressed in a direction from the recording medium to limit contact between the contact terminal and the recording medium, the protruding portion fits in the fitting concave portion at the mounted position such that the contact terminal comes in contact with the recording medium, and the protruding portion is pulled out from the fitting concave portion via action of taking out the process cartridge from a state where the process cartridge is fixed at the mounted position, which is in sliding contact with the slide contact surface portion.

2. The image forming apparatus according to claim 1, wherein the contact terminal is formed of a plate spring member as an elastic body.

3. The image forming apparatus according to claim 1, wherein the contact terminal comprises a main body portion formed of a plate spring member and a protruding portion provided in the main body portion, and the protruding portion is formed of a member different from the main body portion and constitutes a cam member that is in sliding contact with the slide contact surface portion.

4. The image forming apparatus according to claim 3, further comprising an elastic member that presses the contact portion of the contact terminal toward the recording medium.

5. The image forming apparatus according to claim 1, wherein the contact terminal comprises a plurality of contact portions that contact the recording medium.

6. The image forming apparatus according to claim 5, wherein the protruding portion is a cam member, and the cam member is configured to perform contact restriction and release from the contact restriction for the plurality of contact portions, the cam member being in sliding contact with the slide contact surface portion and fitting in the fits concave portion.

7. A cartridge that is detachably mounted from a main body of an image forming apparatus, the cartridge comprising:

a recording medium configured to contact a contact terminal provided at the main body of the image forming apparatus; and a concave portion that is configured to, when the recording medium and the contact terminal come in to contact, receive a protruding portion provided at the main body of the image forming apparatus, the concave portion protrudes further toward the cartridge than the contact terminal, and is formed toward an inside of the cartridge from a surface of the cartridge on which the recording medium is provided, wherein, during insertion of the cartridge, the recording medium slidably contacts the contact terminal in a parallel direction with respect to a sidewall of the main body of the image forming apparatus.

8. The cartridge according to claim 7, wherein the protruding portion is configured not to come in contact with the concave portion.

9. The cartridge according to claim 7, further comprising a slide contact surface portion which is configured to be in sliding contact with the protruding portion in the image forming apparatus, wherein the concave portion is between the recording medium and the slide contact surface portion.

10. The cartridge according to claim 9, wherein the recording medium, the concave portion, and the slide contact surface portion are arranged in this order from upstream to downstream in an insertion direction of the cartridge to the main body of the image forming apparatus.

11. The cartridge according to claim 7, further comprising a toner container in the cartridge.

12. The cartridge according to claim 7, further comprising a photosensitive drum in the cartridge.

13. An image forming apparatus comprising the cartridge according to claim 7, wherein the cartridge is detachably mounted from the image forming apparatus.

14. The cartridge according to claim 7, wherein the contact terminal includes a main body portion and the protruding portion, the protruding portion continuously formed from a lower end of the main body portion.

15. A container that is detachably mounted from a main body of an image forming apparatus, the container comprising:

a recording medium that is configured to contact a contact terminal provided at the main body of the image forming apparatus; and a concave portion that is configured to, when the recording medium and the contact terminal come in to contact, receive a protruding portion provided at the main body of the image forming apparatus, the concave portion protrudes further toward the container than the contact terminal, and is formed toward an inside of the container from a surface of the container on which the recording medium is provided, wherein, during insertion of the container, the recording medium slidably contacts the contact terminal in a parallel direction with respect to a sidewall of the main body of the image forming apparatus.

16. The container according to claim 15, wherein the protruding portion is configured not to come in contact with the concave portion.

17. The container according to claim 15, further comprising a slide contact surface portion which is configured to be in sliding contact with the protruding portion, wherein the concave portion is between the recording medium and the slide contact surface portion.

18. The container according to claim 17, wherein the recording medium, the concave portion, and the slide contact surface portion are arranged in this order from upstream to downstream in an insertion direction of the container to the main body of the image forming apparatus.

19. The container according to claim 15, further comprising a toner container in the container.

20. The container according to claim 15, further comprising a photosensitive drum in the container.

21. An image forming apparatus comprising the container according to claim 15, wherein the container is detachably mounted from the image forming apparatus.

22. The container according to claim 15, wherein the contact terminal includes a main body portion and the protruding portion, the protruding portion continuously formed from a lower end of the main body portion.

23. An image forming apparatus in which a cartridge is detachably mounted from a main body of the image forming apparatus, the image forming apparatus comprising:

a contact terminal provided at the main body of the apparatus, the contact terminal includes a first portion and a second portion, wherein the first portion contacts a recording medium of the cartridge, and the second portion includes a protruding portion such that the protruding portion extends into a concave portion provided in the cartridge, wherein the protruding portion of the contact terminal elastically swings toward a wall of the main body when a pressing force is applied and elastically swings toward the concave portion of the cartridge when the pressing force is released.

* * * * *